United States Patent [19]

Blazek

[11] 4,315,537

[45] Feb. 16, 1982

[54] METHOD OF MAKING A MOLD

[75] Inventor: William S. Blazek, Valley City, Ohio

[73] Assignee: TRW Inc., Cleveland, Ohio

[21] Appl. No.: 688,525

[22] Filed: May 21, 1976

[51] Int. Cl.[3] ..... B22C 9/22; B22C 9/00

[52] U.S. Cl. ..... 164/27; 164/23; 164/34

[58] Field of Search ..... 164/23, 24, 25, 26, 164/27, 21, 34, 165, 361, 137, 246

[56] References Cited

U.S. PATENT DOCUMENTS 3,669,177 6/1972 Ingalls et al. ..... 164/26

3,848,654 11/1974 Boyle et al. ..... 164/137 X

FOREIGN PATENT DOCUMENTS 952284 8/1974 Canada ..... 164/27

*Primary Examiner*—Gus T. Hampilos

*Attorney, Agent, or Firm*—Yount & Tarolli

[57] ABSTRACT

An improved method is utilized to make a mold for a cast product having a plurality of spaced apart surfaces. Although the method could be used for forming molds for different products, the method is advantageously used to form a mold for a cast product having a plurality of airfoils disposed in a circular array. To form the mold, a plurality of airfoil pattern segments are placed in a circular array with surfaces of the segments abutting at joints which are free of material interconnecting the segments. A coating of liquid ceramic mold material is applied over the airfoil pattern segments. Since the joints between the airfoil pattern segments are free of interconnecting material, the liquid ceramic mold material can flow into the joints. After the ceramic mold material has been dried and the airfoil pattern segments disposed of, the ceramic mold material which entered the joints between the airfoil pattern segments forms a plurality of relatively thin projections from the main wall of the mold. These thin projections are broken away before the product is cast in the mold. During the application of the ceramic coating to the airfoil pattern segments, the relatively flexible wax airfoil pattern segments are advantageously supported by a relatively rigid annular pattern member which is disposed outwardly of the airfoil segments.

48 Claims, 9 Drawing Figures

METHOD OF MAKING A MOLD

BACKGROUND OF THE INVENTION

The present invention relates to a new and improved method of making a mold for forming a cast product having a plurality of spaced apart surface areas. The method is advantageously used to form a mold for a plurality of airfoils which are disposed in a circular array.

Turbojet engines commonly include cast components having a plurality of airfoils disposed in a circular array about either a hub which may be rotatable or an outer ring which may be fixed to the casing of the jet engine. Known methods of forming molds for a jet engine component are disclosed in U.S. Pat. Nos. 3,669,177 and 3,848,654. The mold making methods disclosed in these patents contemplate that a plurality of wax airfoil pattern segments will be disposed in a circular array. The pattern segments are then connected together to form a unitary ring by the application of adhesive or hot wax to surfaces of the airfoil pattern segments at joints between the segments.

The application of hot wax or adhesive to the joints between the various airfoil pattern segments is a time consuming process which requires a high degree of manual dexterity. If the hot wax or adhesive is not properly applied at the joints between the pattern segments, imperfections are formed in the cast part. Even if the imperfections are not of such a degree as to require scrapping of the cast part, the correcting of the imperfection further contributes to the cost of forming the part.

Once the airfoil pattern segments have been interconnected in a circular array as disclosed in the aforementioned patents, the circular array of airfoil pattern segments is repetitively dipped in a liquid ceramic mold material. Due to the fact that the airfoil pattern segments are formed of wax and are interconnected by wax at joints between the segments, the circular array of airfoil pattern segments tends to deflect under the influence of forces applied to it as it is repetitively dipped in the liquid ceramic mold material. Of course, any deflection of the airfoil pattern segments impairs the accuracy with which the resulting mold and casting are formed. Pattern materials have been reinforced by the use of a rigid reinforcing member in the pattern material in the manner disclosed in U.S. patent application Ser. No. 676,227 filed Apr. 12, 1976 by William S. Blazek and entitled "Method of Making A Mold".

Another known method of making a mold for casting a component of a jet engine is disclosed in U.S. Pat. No. 4,066,116, issued Jan. 29, 1976, by William S. Blazek et al and entitled "Mold Assembly and Method of Making the Same". This patent discloses a mold having a plurality of separate sections for forming airfoils. Sections of the mold in which an airfoil is formed are made by coating a wax airfoil pattern with a ceramic mold material. The wet coating of ceramic mold material is dried and the pattern destroyed to form a pair of airfoil mold sections which are interconnected to form an airfoil mold cavity. The airfoil mold sections are then connected to hub and ring mold sections to form a mold assembly.

SUMMARY OF THE PRESENT INVENTION

The present invention provides a new and improved method of making a mold for a cast product, such as a turbine engine component, having a plurality of spaced apart surface areas such as airfoils disposed in a circular array. In order to make the mold, a plurality of disposable airfoil pattern segments are arranged in a circular array. In order to minimize cost, the airfoil pattern segments are not interconnected at joints between the segments. A wet coating of liquid ceramic mold material is applied over the circular array of airfoil pattern segments. This liquid ceramic coating is dried and the airfoil pattern segments destroyed to expose ceramic mold surfaces which have configurations corresponding to the configurations of the airfoil pattern segments.

Although applying the ceramic coating to the airfoil pattern segments without interconnecting the segments substantially reduces the time and effort required to form a mold pattern, the liquid ceramic mold material can flow into the joints between the airfoil pattern segments as the pattern is dipped. When the liquid ceramic mold material is subsequently dried and the wax airfoil pattern segments destroyed, the ceramic mold material which entered the joints between the airfoil pattern segments remains as relatively thin projections from the side wall of the mold. These thin projections of ceramic mold material are readily removed.

The circular array of airfoil pattern segments may tend to deflect during repetitive dipping in a liquid ceramic mold material. To prevent this from happening, the circular array of airfoil pattern segments is supported by a relatively rigid circular pattern member. Although it is contemplated that this relatively rigid pattern member could be located radially inwardly of the airfoil pattern segments, the rigid pattern member advantageously has an annular configuration and circumscribes the airfoil pattern segments to supportingly engage their outer end portions. The rigid circular pattern member supports the relatively flexible airfoil pattern segments and holds them against movement relative to each other as the airfoil pattern segments are covered with ceramic mold material.

After the airfoil pattern segments have been covered with a coating of wet ceramic mold material, a portion of the coating is wiped away along a circular area disposed adjacent to the airfoil pattern segments. After the web ceramic coating has been dried and the airfoil pattern segments disposed of, the portion of the ceramic mold material which was previously overlying the airfoil pattern segments can be separated from another portion of the ceramic mold material at the circular area where the wet ceramic mold material was wiped away. This provides access to the interior of the ceramic mold section to enable the ceramic mold material which entered the joints between airfoil pattern segments to be removed and to provide for inspection of the mold surfaces. A second mold section is then connected with the airfoil mold section.

Accordingly, it is an object of this invention to provide a new and improved method of making a mold for a cast product having a plurality of spaced apart surface areas and wherein the method includes the steps of providing a plurality of pattern segments, placing the pattern segments in an array with surfaces abutting at joints which are free of material interconnecting the pattern segments, and applying a wet coating of liquid ceramic mold material over the array of pattern segments with the joints between the pattern segments free of material interconnecting the pattern segments.

Another object of this invention is to provide a new and improved method of making a mold as set forth in the preceding object and wherein the ceramic mold material is dried and the pattern segments disposed of to expose projections of ceramic mold material at locations where the ceramic mold material entered joints between the pattern segments, the projections of ceramic mold material being removed prior to utilization of the mold to form a cast product.

Another object of this invention is to provide a new and improved method of making a cast product having a plurality of airfoils disposed in a circular array and wherein the method includes supporting a circular array of airfoil pattern segments with a relatively rigid circular pattern member during dipping of the circular array of airfoil pattern segments in liquid ceramic mold material to retard relative movement between the pattern segments and subsequently moving the rigid pattern member axially away from a ceramic mold section having airfoil mold cavities formed by the pattern segments.

Another object of this invention is to provide a new and improved method of making a mold for a cast product having a circular wall portion and a plurality of airfoils extending in a circular array from the wall portion and wherein the method includes the step of forming a one-piece annular airfoil mold section having a plurality of radially extending airfoil mold cavities and of positioning a circular mold wall in a coaxial relationship with the airfoil mold section to at least partially define a product mold cavity.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

Figure 1:
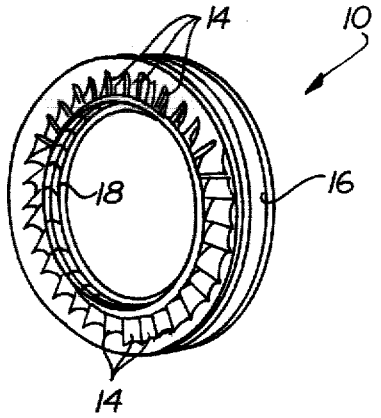
FIG. 1 is a pictorial illustration of a cast product, in the present instance a turbine nozzle, having a plurality of airfoils disposed in a circular array.

A jet turbine engine nozzle 10 is illustrated in FIG. 1. The nozzle 10 includes a circular array of identical airfoils 14 which extend between an annular outer wall or rim 16 and an annular inner wall or hub 18 of the nozzle. The inner and outer walls 16 and 18 and airfoils 14 are integrally molded to form a one-piece cast metal product.

Figure 2:
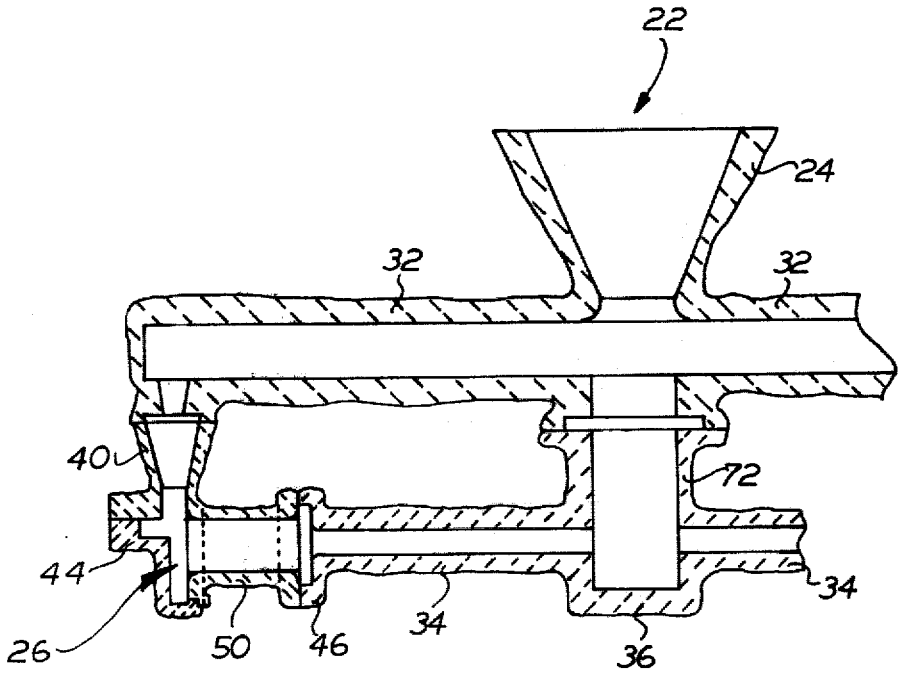
FIG. 2 is an enlarged fragmentary sectional view of a mold assembly for use in forming the cast product of FIG. 1.

A mold assembly 22 (see FIG. 2) is utilized to form the nozzle 10. The mold assembly 22 includes a relatively large central pour cup 24 which is connected with a generally annular mold cavity 26 by a plurality of radially extending upper gating sections 32 and a plurality of radially extending lower gating sections 34. The lower gating sections 34 are connected with the pour cup 24 by a basin 36.

When molten metal is poured into the cup 24, the metal flows into the basin 36 and radially outwardly through the runners or gates 34 to the annular mold cavity 26. After the resin 36 has been filled with molten metal, the radially projecting gates or runners 32 are filled with molten metal which flows through secondary pour cups 40 into the mold cavity 26. It should be understood that although only a single secondary pour cup 40 has been illustrated in FIG. 2 of the drawing, a plurality of secondary pour cups are connected with the annular mold cavity 26 at circumferentially spaced apart locations. Of course, a radially projecting gate or runner 32 is associated with each of the secondary pour cups 40 to enable metal to flow from the main pour cup 24 through the gates and runners 32 to the secondary pour cups 40. The central axis of the main pour cup 24 is coincident with the central axis of the annular mold cavity 26.

In addition to the gating 32 and 34 and pour cup 24, the mold assembly 22 includes a circular outer wall 44 (see FIG. 3) and a circular inner wall 46. The circular inner wall 46 is integrally formed with the gating 34. An annular airfoil mold section 50 is disposed between the inner and outer mold walls 44 and 46. The secondary pour cups 40 are integrally formed with the annular airfoil mold section 50 at spaced apart locations about the circumference of the airfoil mold section.

The inner and outer walls 44 and 46 and airfoil mold section 50 have surfaces which cooperate to define the mold cavity 26. Thus, the mold cavity 26 includes an annular outer rim section 54 having a configuration corresponding to the configuration of the outer rim 16 (see FIG. 1) of the nozzle 10. Similarly, the mold cavity 26 includes an annular inner rim section 56 (FIG. 3) having a configuration corresponding to the configuration of the annular inner wall 18 (FIG. 1) of the nozzle 10. A plurality of radially extending airfoil mold cavities 58 (FIG. 3) extend between the inner and outer rim mold sections 54 and 56. Although only a single airfoil mold cavity 58 has been illustrated in FIG. 3, it should be understood that there are a plurality of identical airfoil mold cavities 58 disposed in a circular array between and connected in fluid communication with the rim mold sections 54 and 56. Of course, the number of airfoil mold cavities 58 in the circular array of mold cavities corresponds to the number of airfoils 14 (see FIG. 1) in the nozzle 10.

The circular outer mold wall 44 is connected with the annular airfoil mold section 50 at a pair of circular joints 62 and 64. Similarly, the circular inner mold wall 46 is connected with the annular airfoil mold section 50 at a pair of circular joints 66 and 68. The joints 62, 64, 66 and 68 are sealed with a suitable cement or other material to prevent the leakage of molten metal from the cavity 26 during a casting operation.

The circular inner mold wall 46 is integrally formed with the basin 36 and an upstanding tubular conduit section 72 through which metal flows from the pour cup 24 (see FIGS. 2 and 4) by repetitively dipping a pattern assembly 76 (FIG. 4) in a liquid ceramic mold material. Although many different types of liquid ceramic mold materials could be utilized, a slurry which contains fused silica, zircon, or other refractory materials in combination with binders such as ethyl silicate, sodium silicate and colloidal silica is utilized. In addition, the slurry may contain suitable film formers such as alginates to control viscosity and wetting agents to control flow characteristics and pattern wettability. Each time the pattern assembly 76 is dip coated, it is dried before subsequent dipping. The pattern assembly 76 is repetitively dipped and dried enough times to build up a covering of ceramic mold material of a desired thickness.

The pattern assembly 76 includes a relatively rigid annular metal pattern member 80 having a circular inner surface 82 to which a cylindrical wax pattern member 84 is connected. It should be noted that the annular metal pattern member 80 is provided with circular projections 88 and 90 which support the wax pattern member 84 during dipping. A relatively large wax pattern element 94 is fixedly connected with the wax pattern 84. The wax pattern element 94 includes a relatively large cylindrical main section 98 and a plurality of radially extending runner sections 100 which are integrally formed with the main section 98.

During dipping, the pattern assembly 76 is supported by a suitable frame 104. Thus, the entire pattern assembly 76 can be repetitively dipped in one or more bodies of liquid ceramic slurry material while the pattern assembly is supported by the frame 104. The rigid annular pattern member 80 supports the wax pattern member 84 and retains it against movement so that a cylindrical mold surface 106 is accurately formed as a covering 110, of a plurality of layers of ceramic mold material, is built up over the pattern assembly. It should be noted that the accurately formed cylindrical mold surface 106 defines a radially inner surface of the cavity 26 (FIG. 3) in which the cast product 10 (FIG. 1) is molded.

After the pattern assembly 76 has been repetitively dipped and each of the resulting layers of ceramic mold material dried, the wax patterns 84 and 94 are disposed of by heating the pattern assembly in a steam autoclave, microwave oven or other method. The mold assembly 76 is then fired at a relatively high temperature to form the covering 110 into a hard ceramic mold section.

Figure 3:
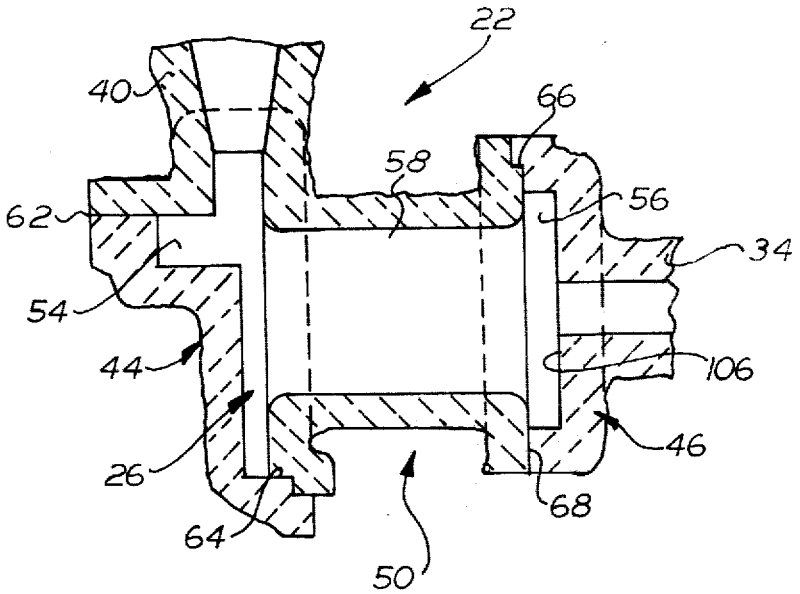
FIG. 3 is an enlarged fragmentary sectional view of a portion of the mold assembly of FIG. 2 and illustrating the relationship between a mold cavity in which an airfoil is formed and a pair of concentric annular mold cavities in which inner and outer rim portions of the cast product are formed.

The mold wall section 46 formed by firing the covering 110 of ceramic mold material is subsequently connected with the annular airfoil mold section 50 in the manner illustrated in FIG. 3. Therefore, the circular surfaces of the inner mold wall section 46 for the joints 66 and 68 must be exposed for connection with the airfoil mold section 50. To this end, a pair of circular end surfaces 114 and 116 (see FIG. 4) of the annular metal pattern member 80 are wiped each time the pattern assembly 76 is dipped to remove the wet coating ceramic mold material overlying these surfaces. The resulting discontinuity in the coating of wet ceramic mold material separates a portion 120 of the covering of ceramic mold material overlying a cylindrical radially outer surface 122 of the pattern member 80 from the portion of the covering 110 of ceramic mold material which engages the radially inner side of the metal pattern member 80.

After wax pattern elements 84 and 94 have been melted and the coverings 110 and 120 of ceramic mold material have been dried prior to firing, the cylindrical ceramic section 120 of the mold material and the metal pattern member 80 can be separated. In addition, the metal pattern member 80 can be separated from the radially inner mold wall 46. This separation of the annular metal pattern member 80 from the circular mold wall 46 is accomplished by merely moving the metal pattern member 80 axially away from the mold wall 46. It should be noted that the circular ridge 90 on the pattern member 80 has a slightly larger diameter than the circular ridge 88 so that the pattern member can be moved axially downwardly (as viewed in FIG. 4) away from the mold wall 46 with the circular metal pattern member 80 intact. This enables the circular pattern member 80 to be subsequently utilized in the formation of other mold assemblies.

To provide an opening for connection with the pour cup 24 (see FIG. 2) a circular outer surface 126 of the upstanding cylindrical portion 98 of the wax pattern element 94 is also wiped each time the pattern assembly 76 is dipped to thereby remove the wet ceramic coating of mold material from the surface 126. Due to the resulting discontinuity in the covering of ceramic mold material over the pattern element 94, after the pattern assembly 76 has been fired, a circular end cap 128 is separated from the ceramic mold material forming the inner mold wall 46. The end cap 126 can be discarded to expose a circular opening which is connected in fluid communication with the pour cup 24 in the manner illustrated in FIG. 2.

Figure 4:
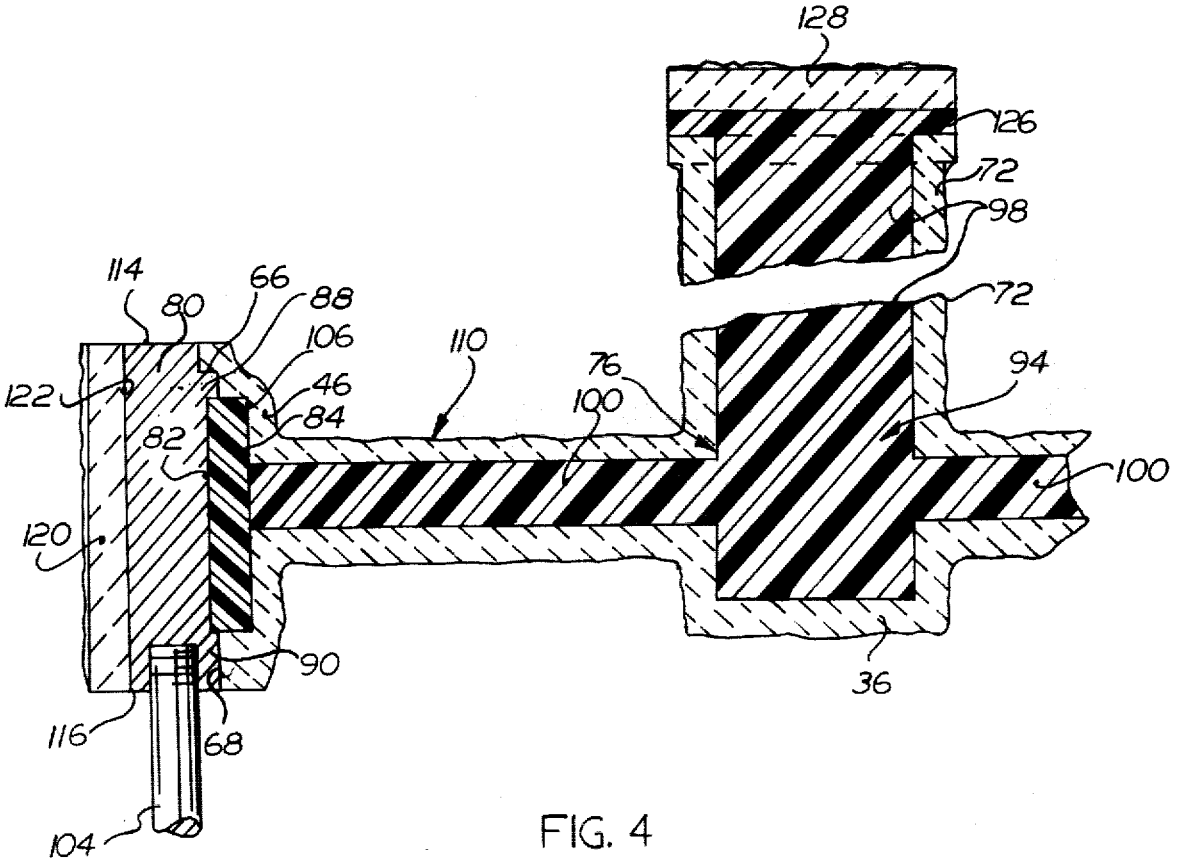
FIG. 4 is a fragmentary sectional view illustrating a pattern assembly which is utilized to form gating to conduct metal from a center pour cup to the airfoil mold cavity of FIG. 3.
Figure 5:
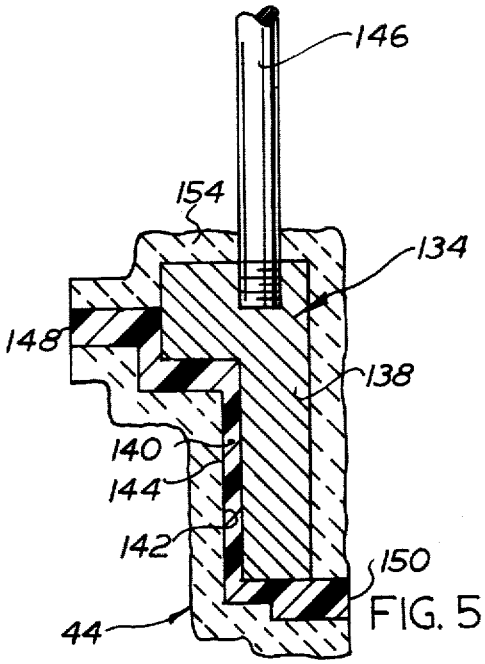
FIG. 5 is a sectional view of an annular pattern assembly utilized to form a circular outer wall of the mold assembly of FIGS. 2 and 3.

The ceramic outer mold wall 44 is formed by repetitively dipping a pattern assembly 134 (FIG. 5) in liquid ceramic mold material in the same manner previously explained in connection with the pattern assembly 76 (FIG. 4). The pattern assembly 134 (FIG. 5) includes a rigid annular metal pattern member 138 to which an annular wax pattern element 140 is connected. The wax pattern element 140 is provided with a circular outer surface 142 having a configuration corresponding to the configuration of a circular inner surface 144 of the mold outer wall 44. Of course, the configuration of the inner surface 144 of the outer mold wall 44 corresponds to the configuration of the annular rim 14 of the turbine engine nozzle 10 (FIG. 1). A frame 146 is connected with the pattern assembly 134 to support it during dipping in a slurry of ceramic mold material.

Each time the pattern assembly 134 (FIG. 5) is dipped in liquid ceramic mold material, the resulting wet coating of ceramic mold material is wiped away from circular outer surfaces 148 and 150 of the wax pattern member 140. Once the surfaces 148 and 150 have been wiped, the remainder of the wet coating of ceramic mold material is dried. The pattern assembly 134 is repetitively dipped, the surfaces 148 and 150 wiped and the resulting coating dried until a covering of ceramic mold material of a desired thickness has been built up over the pattern assembly. The pattern assembly 134 is then heated and the wax pattern member 140 is destroyed. Thereafter the metal pattern member 138 is removed. Since the surfaces 148 and 150 of the wax pattern member 140 were wiped to form a pair of circular discontinuities in the covering of ceramic mold material, the annular metal pattern member 138 can be moved axially away from the circular outer mold wall section 44 with the metal pattern member intact. The portion 154 of ceramic mold material remaining on the metal pattern member 138 is subsequently discarded. The remaining dried mold material is then fired to harden the ceramic mold material in a known manner.

The annular airfoil mold section 50 is formed in a manner which is generally similar to the manner in which the inner and outer mold wall sections 44 and 46 are formed. However, the forming of the annular airfoil mold section 50 is somewhat more difficult since there are a plurality of airfoil mold cavities formed in a circular array in the airfoil mold section 50.

Figure 6:
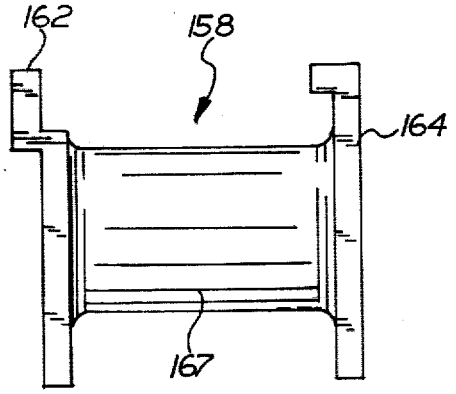
FIG. 6 is an illustration of an airfoil pattern segment.
Figure 7:
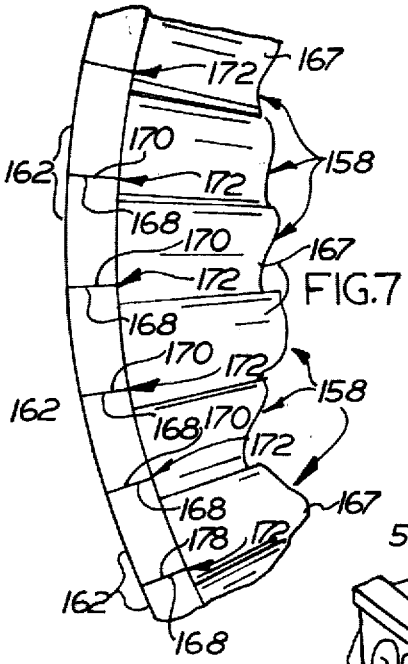
FIG. 7 is a fragmentary schematic illustration depicting how a plurality of airfoil pattern segments are located in a circular array, a portion of which is shown in FIG. 7.

To provide for the formation of the airfoil mold cavities 58, a plurality of airfoil pattern segments 158 (see FIG. 6) are disposed in a circular array. Each of the airfoil segments 158 has an outer shroud or end portion 162 and an inner shroud or end portion 164. The two end portions 162 and 164 are connected by a vane portion 167. When the airfoil pattern segments 158 are arranged in a circular array, side surfaces 168 and 170 (see FIG. 7) are disposed in abutting engagement at generally radially extending joints 172 between the airfoil pattern segments.

Heretofore, it was believed necessary to interconnect the airfoil segments at the joints between the segments in a manner similar to that described in U.S. Pat. No. 3,848,654. However, in accordance with an important feature of the present invention, the joints between the airfoil segments 158 are left free of material interconnecting the segments. This enables an airfoil mold section pattern assembly 174 (FIG. 8) to be formed by merely positioning the wax airfoil pattern segments 158 in an annular array with the inner and outer shrouds or end portions 162 and 164 in abutting engagement. The adjacent end portions 162 and 164 of the airfoil pattern segments 158 are not interconnected by a laborious and time consuming connecting operation utilizing either hot wax or a suitable cement.

Figure 8:
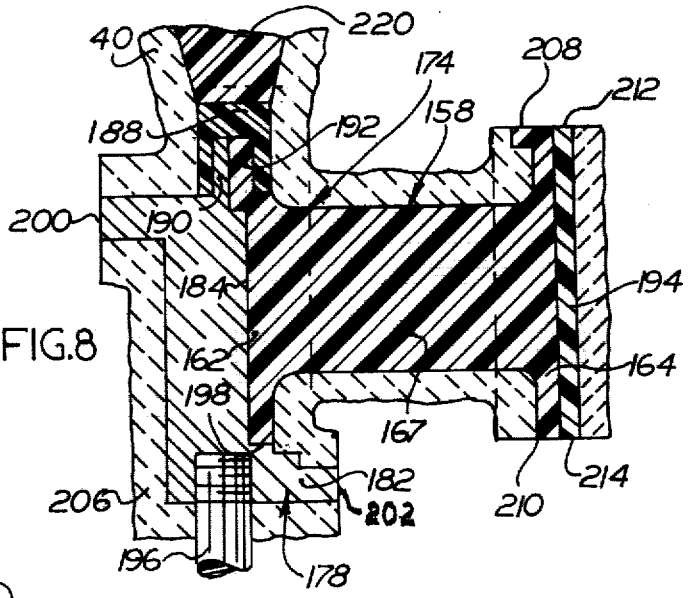
FIG. 8 is a fragmentary sectional view of a pattern assembly utilized in forming a mold section having a plurality of airfoil mold cavities disposed in a circular array.

In making the airfoil mold section pattern assembly 174, the airfoil pattern segments 158 are located in a circular array within an annular metal pattern member 178. The metal pattern member 178 has a circular lower (as viewed in FIG. 8) ledge or protrusion 182 upon which the inner end portions 164 of the wax airfoil pattern segments 158 are disposed. The metal pattern member 178 also has a cylindrical inner surface 184 which is engaged by the axially outer end faces of the airfoil pattern segments 158. Although only a single airfoil pattern segment 158 is illustrated in FIG. 8, a plurality of wax airfoil pattern segments 158 are disposed within the annular metal pattern member 178 with their radially inner and outer end portions 162 and 164 in abutting engagement in the manner illustrated schematically in FIG. 7. It should be noted that the wax airfoil pattern segments are merely layed inside of the annular metal pattern member 178 and are not interconnected at the joints 172 between the abutting radially outer end portions 162 of the airfoil pattern segments and the joints between the abutting radially inner end portions 164 of the airfoil pattern segments. This eliminates a time consuming and delicate connecting operation utilizing either adhesives or hot wax.

In order to hold the airfoil segments 158 in position on the annular metal pattern member 178, an annular wax cap 188 having a generally U-shaped cross sectional configuration extends over an axially projecting annular rib 190 formed on the pattern member 178 and upper portions 192 of the airfoil segments 158. Thus, the wax cap 188 clamps the end portion 162 of each of the airfoil pattern segments 158 against the circular ridge 190 formed on the annular metal pattern member 178 to hold the airfoil pattern segments 158 against radial movement relative to the rigid annular metal pattern member 178. A cylindrical wax retaining member 194 is sized so as to press against the radially inner end portions 164 of the airfoil pattern segments 158 to urge them axially outwardly into engagement with the surface 184 of the metal pattern member 178.

To form the ceramic airfoil mold section 50 (FIG. 3), the pattern assembly 174 (FIG. 8) is repetitively dipped in liquid ceramic mold material. Each of the wet dip coatings is at least partially dried before the next dipping of the pattern assembly 174. During dipping of the pattern assembly 174, the relatively rigid metal pattern member 178 supports the relatively flexible wax airfoil pattern segments 158 to hold them against movement relative to each other and to prevent deflection of the airfoil pattern segments. In this regard, it should be noted that the pattern assembly is inverted from the position shown in FIG. 8 prior to dipping and is moved downward by suitable frame 196 into a body of liquid ceramic mold material in the manner such that the radially outer end portions 162 of the airfoil pattern segments 158 are pressed against a circular surface 198 of the annular rib 182 formed on the rigid metal pattern member 178. Since the circular array of airfoil pattern segments 158 is circumscribed by the annular metal pattern member 178, the annular array of airfoil pattern segments is supported during the application of the liquid ceramic mold material to the pattern segments to thereby promote the accurate formation of the airfoil mold section 50.

To enable the metal pattern member 178 to be separated from the airfoil mold section 50, the metal pattern member is wiped along a circular radially outer side surface 200 and along a circular axially outer side surface 202 each time the pattern assembly 174 is dipped. By wiping the wet ceramic coating away from the circular surfaces 200 and 202 each time the pattern assembly 174 is dipped and prior to drying of the coating, the covering of ceramic mold material overlying the pattern assembly 174 is divided into a portion overlying the airfoil segments 158 and having a configuration corresponding to the configuration of the airfoil mold section 50 and a portion 206 which is disposed on a radially outer side of the metal pattern member 178. The resulting circular discontinuities in covering of ceramic mold material at the surface 200 and 202 separates the portion of the ceramic covering on the radially outer side of the metal pattern member 178 from the portion of the ceramic covering over the airfoil pattern segments 158 so that they can be easily separated.

A circular surface area 208 and a circular surface area 210 on radially inner end portions 164 of the airfoil pattern segments 158 are wiped along with circular end surfaces 212 and 214 of the cylindrical wax pattern element 194 each time the pattern assembly 174 is dipped. The resulting circular discontinuities in the covering of ceramic mold material separates the ceramic mold material overlying the airfoil pattern segments 158 from the ceramic mold material overlying the pattern element 194. The covering of ceramic mold material overlying the radially inner surface of the cylindrical wax pattern element 194 can be discarded along with the ceramic mold material overlying the radially outer surface of the metal pattern member 178 after the pattern assembly 174 has been fired.

The pattern assembly 174 is heated in a suitable manner so that the wax airfoil pattern segments 158, wax cap 188 and wax pattern element 194 are melted. This enables the metal pattern member 178 to be removed intact from the airfoil mold section 50 by merely moving the metal pattern member axially away from the airfoil mold section 50, that is in a downward direction as viewed in FIG. 8. It should be noted that suitable wax pattern elements 220 are connected with the wax cap 188 to form the auxiliary sprue cups 40.

Figure 9:
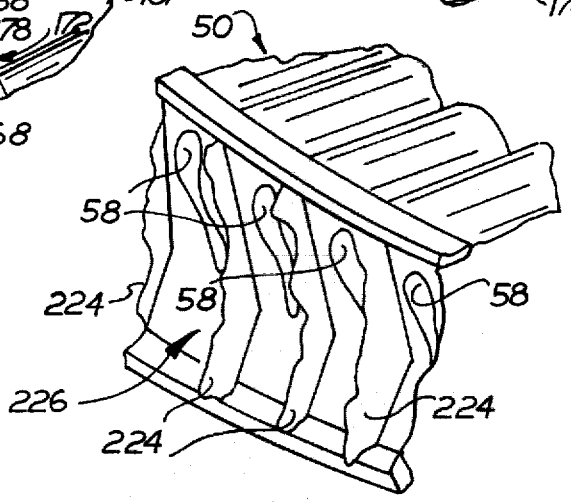
FIG. 9 is a schematic fragmentary sectional view illustrating the manner in which thin projections of ceramic mold material are formed at joint locations between the airfoil pattern segments of FIG. 7 during covering of the pattern segments with ceramic mold material.

After the metal pattern member 178 has been removed and the ceramic mold material fired, the radially outer end portions of the airfoil mold cavities 58 are exposed (see FIG. 9). Since the outer end portions 162 of the airfoil pattern segments 158 were not interconnected prior to dipping, ceramic mold material entered the joints between the airfoil pattern segments 158 as they were dipped. This results in the formation of a plurality of radially extending thin projections 224 from a circular radially outer surface 226 of the airfoil mold section 50 (see FIG. 9).

If the thin ceramic projections 224 were left on the surface 226 of the airfoil mold section 50, correspondingly shaped slots or indentations would be formed in the cast turbine nozzle 10. Since the formation of such slots would be objectionable, the radially projecting portions 224 of ceramic mold material are removed from the surface 226 prior to connecting the airfoil mold section 50 with the inner and outer walls 46 and 44 of the mold assembly 22. The thin ceramic projections 224 can be readily broken off and the surface 226 finished to a smooth configuration so that the inner surface of the nozzle rim 114 will have a smooth configuration.

Since the airfoil segments are also free of interconnecting material at the radially inner end portions 164 of the airfoil segments, thin vanes or projections of ceramic mold material, similar to the projections 224 of FIG. 9, will be formed at a radially inner surface of the airfoil mold section. These projections must also be broken away and the radially inner surface finished before the airfoil mold section 50 is connected with the outer and inner walls 44 and 46 of the mold assembly 22. It should be noted that the effort required to remove the ceramic projections formed at the joints between the airfoil pattern segments 158 is far less than the effort which would be required to interconnect the airfoil pattern segments 158 with hot wax or cement.

In view of the foregoing it is apparent that the present invention provides a new and improved method of making a mold assembly 22 for a cast product 10 having a plurality of airfoils 14 disposed in a circular array. In order to make the mold assembly 22, a plurality of disposable airfoil pattern segments 158 are arranged in a circular array. In order to minimize cost, the airfoil pattern segments 158 are not interconnected at joints 172 between the segments. A wet coating of liquid ceramic mold material is applied over the circular array of airfoil pattern segments. This liquid ceramic coating is dried and the airfoil pattern segments 158 are destroyed to expose ceramic mold surfaces which have configurations corresponding to the configurations of the airfoil pattern segments.

Although applying the ceramic coating to the airfoil pattern segments 158 without interconnecting the segments substantially reduces the time and effort required to form the pattern assembly 174, the liquid ceramic mold material can flow into the joints between the airfoil pattern segments as the pattern assembly is dipped. When the liquid ceramic mold material is subsequently dried and the wax airfoil pattern segments 158 destroyed, the ceramic mold material which entered the joints between the airfoil pattern segments 158 remains as relatively thin projections 224 from the side wall 226 of the mold. These thin projections of ceramic mold material are readily removed.

The circular array of airfoil pattern segments 158 may tend to deflect during repetitive dipping in a liquid ceramic mold material. To prevent this from happening, the circular array of airfoil pattern segments is supported by a relatively rigid circular pattern member 178. Although it is contemplated that this relatively rigid pattern member could be located radially inwardly of the airfoil pattern segments 158, the rigid pattern member advantageously has an annular configuration and circumscribes the airfoil pattern segments to supportingly engage their outer end portions. The rigid circular pattern member 178 supports the relatively flexible airfoil pattern segments 158 and holds them against movement relative to each other as the airfoil pattern segments are covered with ceramic mold material.

After the airfoil pattern segments 158 have been covered with a coating of wet ceramic mold material, a portion of the coating is wiped along circular areas 200 and 202 disposed adjacent to the airfoil pattern segments 158. After the wet ceramic coating has been dried and the airfoil pattern segments disposed of, the portion of the ceramic mold material which was previously overlying the airfoil pattern segments 158 can be separated from another portion 206 of the ceramic mold material at the circular areas where the wet ceramic mold material was wiped away. This provides access to the interior of the ceramic mold section 50 to enable the ceramic mold material which entered the joints between airfoil pattern segments to be removed and to provide for inspection of the mold surfaces. A pair of mold walls 44 and 46 are then connected with the airfoil mold section 50 to form the generally annular mold cavity 26.

Although the invention has been described herein and is particularly advantageous in association with a cast product having a plurality of airfoils disposed in a circular array, it is contemplated that the invention could be utilized in forming other types of cast products.

Having described a specific preferred embodiment of the invention, the following is claimed:

1. A method of making a mold for a cast product having a plurality of airfoils disposed in a circular array, said method comprising the steps of providing a plurality of airfoil pattern segments formed of a relatively flexible and disposable material, providing a circular pattern member formed of a material having a greater rigidity than material forming the airfoil pattern segments, placing the airfoil pattern segments in a circular array engaging the circular pattern member to form a pattern assembly, said step of placing the airfoil pattern segments in a circular array includes placing the airfoil pattern segments in an array with joints between the airfoil pattern segments free of material interconnecting the airfoil pattern segments so that the airfoil pattern segments can be readily moved relative to each other, connecting the airfoil pattern segments with the circular pattern member to thereby retard movement of the airfoil pattern segments relative to each other and the circular pattern member while maintaining the joints between the airfoil pattern segments free of material interconnecting the airfoil pattern segments, repetitively dipping the pattern assembly in liquid ceramic mold material to form a covering of ceramic mold material overlying at least a portion of the pattern assembly, at least partially supporting the airfoil pattern segments with the relatively rigid circular pattern member during said dipping steps, at least partially drying the covering of ceramic mold material overlying the pattern assembly, disposing of the airfoil pattern segments to expose a circular array of ceramic airfoil mold surfaces having configurations corresponding to the configurations of the airfoil pattern segments, and moving the relatively rigid circular pattern member away from the ceramic airfoil mold surface after performing said step of disposing of the airfoil pattern segments.

2. A method as set forth in claim 1 wherein said step of connecting the airfoil pattern segments to the circular pattern member includes the steps of providing an annular connector member and engaging the circular pattern member and an end portion of each of the airfoil pattern segments with the annular connector member.

3. A method as set forth in claim 2 further including the step of disposing of the annular connector member simultaneously with performance of said step of disposing of the airfoil pattern segments.

4. A method as set forth in claim 1 wherein said step of connecting the airfoil pattern segments with the circular pattern member includes the step of clamping one end portion of each of the airfoil pattern segments to the circular pattern member.

5. A method of making a mold for a cast product having a plurality of airfoils disposed in a circular array, said method comprising the steps of providing a plurality of airfoil pattern segments formed of a relatively flexible and disposable material, providing a circular pattern member formed of a material having a greater rigidity than material forming the airfoil pattern segments, placing the airfoil pattern segments in a circular array with radially outer end portions of the airfoil pattern segments engaging the circular pattern member to form a pattern assembly, clamping the radially outer end portion of each of the airfoil pattern segments to the circular pattern member, repetitively dipping the pattern assembly in liquid ceramic mold material to form a covering of ceramic mold material overlying at least a portion of the pattern assembly, retarding relative movement between the airfoil pattern segments during said dipping steps by at least partially supporting the airfoil pattern segments with the relatively rigid circular pattern member, at least partially drying the covering of ceramic mold material overlying the pattern assembly, disposing of the airfoil pattern segments to expose a circular array of ceramic airfoil mold surfaces having configurations corresponding to the configuration of the airfoil pattern segments, and moving the relatively rigid circular pattern member away from the ceramic airfoil mold surfaces.

6. A method as set forth in claim 5 further including the steps of providing a circular retaining member and engaging the radially inner end portions of each of the airfoil pattern segments with the retaining member.

7. A method as set forth in claim 6 wherein said step of clamping the radially outer end portion of each of the airfoil pattern segments to the circular pattern member includes the step of providing at least one clamp member, said method further including the step of disposing of said clamp member and said retaining member simultaneously with performance of said step of disposing of the airfoil pattern segments.

8. A method as set forth in claim 5 wherein said step of placing the airfoil pattern segments in a circular array includes the step of placing the airfoil pattern segments in an array with joints between the airfoil pattern segments free of material interconnecting the airfoil pattern segments so that the airfoil pattern segments can be readily moved relative to each other prior to performance of said step of clamping radially outer end portions of the airfoil pattern segments to the circular pattern member.

9. A method of making a mold for a cast product having a plurality of airfoils disposed in a circular array, said method comprising the steps of providing a plurality of wax airfoil pattern segments, providing a circular metal pattern member, clamping each of the wax airfoil pattern segments to the circular metal pattern member to form a circular array of airfoil pattern segments which are connected with the circular metal pattern member, leaving joints between the wax airfoil pattern segments free of material interconnecting the airfoil pattern segments, applying a covering of liquid ceramic mold material over exposed surface areas of the wax airfoil pattern segments and over at least a portion of the circular metal pattern member while the wax airfoil pattern segments are clamped to the circular metal pattern member, at least partially supporting the wax airfoil pattern segments with the circular metal pattern member during the application of the covering of liquid ceramic mold material to the airfoil pattern segments and to the pattern member, at least partially drying the covering of ceramic mold material overlying the wax airfoil pattern segments and circular metal pattern member, and disposing of the wax airfoil pattern segments while maintaining the circular metal pattern member intact and removing the circular pattern member to expose a circular array of ceramic airfoil mold surfaces having configurations corresponding to the configurations of the wax airfoil pattern segments.

10. A method as set forth in claim 9 wherein said step of clamping each of the wax airfoil pattern segments to the circular metal pattern member includes the steps of providing at least one clamp member and pressing a surface of a wax airfoil pattern segment against the metal pattern member with the clamp member.

11. A method as set forth in claim 10 wherein said step of providing a clamp member includes the step of providing a wax clamp member, said method further including the step of disposing of the wax clamp member simultaneously with disposing of the wax airfoil pattern segments.

12. A method of making a mold for a cast product having a circular wall portion with a plurality of airfoils disposed in a circular array and extending generally radially from the wall portion, said method comprising the steps of forming a one-piece annular airfoil mold section having a plurality of radially extending airfoil mold cavities with exposed open end portions disposed in a circular array, said step of forming an airfoil mold section including the steps of providing a plurality of airfoil pattern segments, placing the airfoil pattern segments in a circular array, applying a wet coating of liquid ceramic mold material over the airfoil pattern segments, forming a circular discontinuity in the wet coating of ceramic mold material adjacent to end portions of the airfoil pattern segments, at least partially drying the wet coating of ceramic mold material to form a solid covering of ceramic mold material having a circular discontinuity at the location where the circular discontinuity was formed in the wet coating of ceramic mold material, removing the airfoil pattern segments, and separating the covering of ceramic mold material at the circular discontinuity to separate a portion of the covering corresponding to the airfoil mold section from another portion of the covering, forming a one-piece circular mold wall, said step of forming a mold wall including the steps of providing a circular pattern surface, applying a coating of liquid ceramic mold material over the circular pattern surface, at least partially drying the coating of liquid ceramic mold material disposed over the pattern surface, and removing the pattern surface, and positioning the circular mold wall in a coaxial relationship with the annular airfoil mold section with a generally axially extending surface of the circular mold wall spaced apart from and facing the open end portions of the radially extending airfoil mold cavities to at least partially define a product mold cavity.

13. A method as set forth in claim 12 wherein said step of placing the airfoil pattern segments in a circular array includes the step of positioning the airfoil pattern segments with surfaces in abutting engagement at joints which are free of material interconnecting the airfoil pattern segments, said step of applying a coating of liquid ceramic mold material over the airfoil pattern segments being performed with the joints between airfoil pattern segments free of material interconnecting the airfoil pattern segments.

14. A method as set forth in claim 12 wherein the step of forming an airfoil mold section further includes the step of forming a second circular discontinuity in the coating of ceramic mold material adjacent to end portions of the airfoil pattern segments while the coating of ceramic mold material is wet to further divide the coating of ceramic mold material into portions which can be separated after performing said step of drying the coating of ceramic mold material.

15. A method as set forth in claim 12 wherein said step of forming an airfoil mold section includes the step of providing an annular member, said step of placing the pattern segments in a circular array includes the step of placing at least a portion of each of the pattern segments in a circular area circumscribed by the annular member to form a circular array of pattern segments which is coaxial with the circular member, said step of applying a coating of liquid ceramic mold material over the pattern segments including the steps of at least partially supporting the pattern segments with the annular member and dipping the annular member and pattern segments in liquid ceramic mold material while at least partially supporting the annular array of pattern segments with the annular member.

16. A method of making a mold for a cast product having a plurality of airfoils disposed in a circular array, said method comprising the steps of providing a plurality of disposable airfoil pattern segments, placing the airfoil pattern segments in a circular array with surfaces of the airfoil pattern segments abutting at joints which are free of material interconnecting the airfoil pattern segments, applying a wet coating of liquid ceramic mold material over the circular array of airfoil pattern segments with the joints between airfoil pattern segments free of material interconnecting the airfoil pattern segments, allowing liquid ceramic mold material to flow into at least some of the joints between the airfoil pattern segments while performing said step of applying a coating of liquid ceramic mold material to the circular array of airfoil pattern segments, at least partially drying the ceramic mold material in the joints between the airfoil pattern segments and the ceramic mold material overlying the circular array of airfoil pattern segments, disposing of the airfoil pattern segments to expose a circular array of ceramic mold surfaces having configurations corresponding to the configurations of the airfoil pattern segments and to expose projections of ceramic mold material at locations where the ceramic mold material entered the joints between the airfoil pattern segments, and removing the projections of ceramic mold material at the locations where the ceramic mold material entered the joints between the pattern segments.

17. A method as set forth in claim 16 further including the step of providing a circular pattern member, said step of placing the airfoil pattern segments in a circular array including the step of placing the airfoil pattern segments in a circular array within the circular pattern member, said member further including the steps of applying a wet coating of liquid ceramic mold material over the circular pattern member simultaneously with the application of a coating of ceramic mold material to the airfoil pattern segments, and removing at least a major portion of the wet coating of ceramic mold material overlying a circular surface area of the pattern member at a location disposed outwardly of the circular array of airfoil pattern segments to separate at least a portion of the coating of wet ceramic mold material overlying the pattern member from the coating of wet ceramic mold material overlying the circular array of airfoil pattern segments.

18. A method as set forth in claim 16 further including the step of providing a circular pattern member of a material having a rigidity which is greater than the rigidity of the airfoil pattern segments, said step of placing the airfoil pattern segments in a circular array including the step of placing the airfoil segments in a circular array in association with the circular pattern member, said step of applying a coating of liquid ceramic mold material over the circular array of airfoil pattern segments including the step of dipping the circular array of airfoil pattern segments and the circular pattern member in a body of liquid ceramic mold material, said method further including the step of retarding relative movement between the airfoil pattern segments during said dipping step by at least partially supporting the airfoil pattern segments with the circular pattern member.

19. A method as set forth in claim 16 further including the steps of wiping away at least a major portion of the wet coating of ceramic mold material overlying a circular surface area adjacent to a radially inner portion of the circular array of airfoil pattern segments prior to performing said step of drying the ceramic mold material and wiping away at least a major portion of the wet coating of ceramic mold material overlying a circular surface area adjacent to a radially outer portion of the circular array of airfoil patterns prior to performing said step of drying the ceramic mold material.

20. A method of making a mold for a cast product having a plurality of spaced apart surface areas, said method comprising the steps of providing a plurality of disposable pattern segments formed of a relatively flexible material and having surfaces corresponding to the spaced apart surface areas of the cast product, providing a pattern member formed of a material having a greater rigidity than the material forming the pattern segments, clamping each of the pattern segments to the pattern member with the pattern segments disposed in an array with surfaces of the pattern segments abutting at joints which are free of material interconnecting the pattern segments, applying a wet coating of liquid ceramic mold material over the pattern member and the array of pattern segments with the joints between pattern segments free of material interconnecting the pattern segments and while the pattern segments are clamped to the pattern member, at least partially drying the coating of ceramic mold material overlying the array of pattern segments, disposing of the pattern segments to expose an array of ceramic mold surfaces having configurations corresponding to the configurations of the spaced apart surface areas of the cast product, and moving the pattern member away from the ceramic mold surfaces.

21. A method of making a mold for a cast product having a plurality of spaced apart surface areas, said method comprising the steps of providing a plurality of disposable pattern segments having surfaces corresponding to the spaced apart surface areas of the cast product, placing the pattern segments in an array with surfaces of the pattern segments abutting at joints which are free of material interconnecting the pattern segments, applying a wet coating of liquid ceramic mold material over the array of pattern segments with the joints between pattern segments free of material interconnecting the pattern segments, flowing ceramic mold material into at least some of the joints between the pattern segments while performing said step of applying a coating of liquid ceramic mold material to the array of pattern segments, at least partially drying the coating of ceramic mold material overlying the array of pattern segments, said step of drying the coating of ceramic mold material including the step of at least partially drying the ceramic mold material which enters the joints between the pattern to form projections of ceramic mold material, disposing of the pattern segments to expose an array of ceramic mold surfaces having configurations corresponding to the configurations of the spaced apart surface areas of the cast product, said step of disposing of the pattern segments including the step of leaving the projections of ceramic mold material extending from ceramic mold surfaces at locations where the liquid ceramic mold material entered the joints between the pattern segments, and removing the projections of ceramic mold material from the mold surfaces after having performed said step of disposing of the pattern segments.

22. A method as set forth in claim 21 further including the step of providing a mold wall pattern having an outer surface of a size which is greater than the size of the array of spaced apart surface areas in the cast product, applying a coating of ceramic mold material to the outer surface of the mold wall pattern, at least partially drying the coating of ceramic mold material overlying the outer surface of the mold wall pattern, separating the dried coating of ceramic mold material from the mold wall pattern to form a mold wall section, and positioning the mold wall section in association with the array of ceramic mold surfaces having a configuration corresponding to the configuration of the pattern segments to at least partially define a mold cavity extending around the array of mold surfaces having a configuration corresponding to the configuration of the pattern segments.

23. A method as set forth in claim 21 further including the step of providing a pattern member, said step of placing the pattern segments in an array including the step of placing the pattern segments in an array within the pattern member, said method further including the steps of applying a wet coating of liquid ceramic mold material over the pattern member simultaneously with the application of a coating of ceramic mold material to the pattern segments, and removing at least a major portion of the wet coating of ceramic mold material overlying a surface area of the pattern member at a location disposed outwardly of the array of pattern segments to separate at least a portion of the coating of wet ceramic mold material overlying the pattern member from the coating of wet ceramic mold material overlying the array of pattern segments.

24. A method as set forth in claim 21 further including the step of providing a pattern member of a material having a rigidity which is greater than the rigidity of the pattern segments, said step of placing the pattern segments in an array including the step of placing the segments in an array in association with the pattern member, said step of applying a coating of liquid ceramic mold material over the array of pattern segments including the step of dipping the array of pattern segments and the pattern member in a body of liquid ceramic mold material, said method further including the step of retarding relative movement between the pattern segments during said dipping step by at least partially supporting the pattern segments with the pattern member.

25. A method as set forth in claim 25 further including the steps of wiping away at least a major portion of the wet coating of ceramic mold material overlying a surface area adjacent to an inner portion of the array of pattern segments prior to performing said step of drying the ceramic mold material and wiping away at least a major portion of the wet coating of ceramic mold material overlying a surface area adjacent to an outer portion of the array of patterns prior to performing said step of drying the ceramic mold material.

26. A method of making a mold for a cast product having a plurality of airfoils disposed in a circular array, said method comprising the steps of providing a plurality of airfoil pattern segments, providing an annular pattern member, placing at least a portion of each of the airfoil pattern segments in a circular area circumscribed by the pattern member to form a circular array of airfoil pattern segments which are circumscribed by the annular pattern member, said step of placing the airfoil pattern segments in a circular area circumscribed by the pattern member includes the step of positioning the airfoil pattern segments with surfaces in abutting engagement at joints which are free of material interconnecting the airfoil pattern segments, applying a covering of liquid ceramic mold material over exposed surface areas of the airfoil pattern segments and over at least a portion of the annular pattern member, said step of applying a covering of liquid ceramic mold material over the airfoil pattern segments being performed with the joints between airfoil pattern segments free of material interconnecting the airfoil pattern segments, retarding relative movement between airfoil pattern segments with the annular pattern member during the application of the covering of liquid ceramic mold material to the airfoil pattern segments and to the annular pattern member, at least partially drying the covering of ceramic mold material overlying the airfoil pattern segments and annular pattern member, and removing the annular pattern member and airfoil pattern segments to expose a circular mold wall area and to expose a circular array of ceramic airfoil mold surfaces integrally formed with and extending generally inwardly from the mold wall, each of said airfoil mold surfaces having a configuration corresponding to the configuration of an airfoil pattern segment.

27. A method of making a mold for a cast product having a plurality of airfoils disposed in a circular array, said method comprising the steps of providing a plurality of airfoil pattern segments formed of a relatively flexible and disposable material, providing a circular pattern member formed of a material having a greater rigidity than material forming the airfoil pattern segments, placing the airfoil pattern segments in a circular array engaging the circular pattern member to form a pattern assembly, said step of placing the airfoil pattern segments in a circular array includes positioning the airfoil pattern segments with surfaces in abutting engagement at joints which are free of material interconnecting the airfoil pattern segments, repetitively dipping the pattern assembly in liquid ceramic mold material to form a covering of ceramic mold material overlying at least a portion of the pattern assembly, said step of repetitively dipping the pattern assembly in liquid ceramic mold material including the step of flowing ceramic mold material into at least some of the joints between airfoil pattern segments, retarding relative movement between the airfoil pattern segments during said dipping steps by at least partially supporting the airfoil pattern segments with the relatively rigid circular pattern member, at least partially drying the covering of ceramic mold material overlying the pattern assembly, disposing of the airfoil pattern segments to expose a circular array of ceramic airfoil mold surfaces having configurations corresponding to the configurations of the airfoil pattern segments, said step of disposing of the airfoil pattern segments including the step of leaving projections of ceramic mold material at locations where the liquid ceramic mold material entered the joints betweenn the airfoil pattern segments, moving the relatively rigid circular pattern member away from the ceramic airfoil mold surfaces, and removing the projections of ceramic mold material.

28. A method as set forth in claim 27 further including the step of providing a disposable circular pattern surface having a diameter which is greater than the outer diameter of the circular array of ceramic airfoil mold surfaces, repetitively dipping the circular pattern surface in liquid ceramic mold material to form a covering of ceramic mold material over the circular pattern surface, at least partially drying the covering of ceramic mold material overlying the circular pattern surface, providing a circular mold section having a wall with a diameter which is greater than the diameter of the circular array of ceramic airfoil mold surfaces by disposing of the circular pattern surface, and positioning the circular mold section in association with the circular array of ceramic mold surfaces to at least partially define an annular mold cavity connected in communication with the circular array of airfoil mold surfaces.

29. A method as set forth in claim 27 further including the step of removing at least a portion of the covering of ceramic mold material from a circular surface area of the pattern assembly disposed adjacent to a radially outer portion of the circular array of airfoil pattern segments after performing at least ome of said dipping steps.

30. A method as set forth in claim 27 wherein said step of providing a circular pattern member includes the step of providing an annular metal pattern member, said step of providing a plurality of airfoil pattern segments including the steps of providing a plurality of airfoil pattern segments composed of wax, said step of placing the airfoil pattern segments in a circular array including the step of placing the wax airfoil pattern segments in a circular area circumscribed by the annular metal pattern member, said step of disposing of the airfoil pattern segments including the step of melting the wax airfoil pattern segments.

31. A method of making a mold for a cast product having a plurality of spaced apart surface areas, said method comprising the steps of providing a plurality of disposable pattern segments formed of a relatively flexible material and having surfaces corresponding to the spaced apart surface areas of the cast product, providing a pattern member formed of a material having a greater ridigity than the material forming the pattern segments, clamping each of the pattern segments to the pattern member with the pattern segments disposed in an array with surfaces of the pattern segments abutting at joints which are free of material interconnecting the pattern segments, said step of clamping each of the pattern segments to the pattern member including providing at least one clamp member and pressing a surface on one of the pattern segments against a surface on the pattern member with the clamp member, applying a wet coating of liquid ceramic mold material over the pattern member and the array of pattern segments with the joints between pattern segments free of material interconnecting the pattern segments and while the pattern segments are clamped to the pattern member, at least partially drying the coating of ceramic mold material overlying the array of pattern segments, disposing of the pattern segments to expose an array of ceramic mold surfaces having configurations corresponding to the configurations of the spaced apart surface areas of the cast product, and moving the pattern member away from the ceramic mold surfaces.

32. A method as set forth in claim 31 further including the step of disposing of the clamp member simultaneously with performance of said step of disposing of the pattern segments.

33. A method of making a mold for a cast product having a plurality of airfoils disposed in a circular array, said method comprising the steps of providing a plurality of airfoil pattern segments formed of a relatively flexible and disposable material, providing a circular pattern member formed of a material having a greater rigidity than material forming the airfoil pattern segments, placing the airfoil pattern segments in a circular array with end portions of the airfoil pattern segments engaging the circular pattern member to form a pattern assembly, clamping the end portion of each of the airfoil pattern segments against the circular pattern member, repetitively dipping the pattern assembly in liquid ceramic mold material to form a covering of ceramic mold material overlying at least a portion of the pattern assembly, retarding relative movement between the airfoil pattern segments during said dipping steps by at least partially supporting the airfoil pattern segments with the relatively rigid circular pattern member, at least partially drying the covering of ceramic mold material overlying the pattern assembly, disposing of the airfoil pattern segments to expose a circular array of ceramic airfoil mold surfaces having configurations corresponding to the configurations of the airfoil pattern segments, and moving the relatively rigid circular pattern member away from the ceramic airfoil mold surfaces.

34. A method of making a mold for a cast product having a plurality of airfoils disposed in a circular array, said method comprising the steps of providing a plurality of airfoil pattern segments, providing an annular pattern member, placing at least a portion of each of the airfoil pattern segments in a circular area circumscribed by the pattern member, said step of placing the airfoil pattern segments in a circular area circumscribed by the pattern member includes the step of positioning the airfoil pattern segments with surfaces in abutting engagement at joints which are free of material interconnecting the airfoil pattern segments, applying a covering of liquid ceramic mold material over exposed surface areas of the airfoil pattern segments and over at least a portion of the annular pattern member, said step of applying a covering of liquid ceramic mold material over the airfoil pattern segments being performed with the joints between airfoil pattern segments free of material interconnecting the airfoil pattern segments, retarding relative movement between airfoil patterns segments with the annular pattern member during the application of the covering of liquid ceramic mold material to the airfoil pattern segments and to the annular pattern member, at least partially drying the covering of ceramic mold material overlying the airfoil pattern segments and annular pattern member, forming a circular discontinuity in the covering of wet ceramic mold material to at least partially divide the covering of ceramic mold material into portions which can be separated after performing said step of drying the covering of ceramic mold material, and removing the annular pattern member and airfoil pattern segments to expose a circular mold wall area and to expose a circular array of ceramic airfoil mold surfaces integrally formed with and extending generally inwardly from the mold wall, each of said airfoil mold surfaces having a configuration corresponding to the configuration of an airfoil pattern segment.

35. A method of making a mold for a cast product having a plurality of spaced apart surface areas, said method comprising the steps of providing a plurality of disposable pattern segments formed of a relatively flexible material and having surfaces corresponding to the spaced apart surface areas of the cast product, providing a pattern member formed of a material having a greater rigidity than the material forming the pattern segments, clamping each of the pattern segments to the pattern member with the pattern segments disposed in an array with surfaces of the pattern segments abutting at joints which are free of material interconnecting the pattern segments, applying a wet coating of liquid ceramic mold material over the pattern member and the array of pattern segments with the joints between pattern segments free of material interconnecting the pattern segments and while the pattern segments are clamped to the pattern member, flowing ceramic mold material into at least some of the joints between the pattern segments while performing said step of applying a coating of liquid ceramic mold material to the array of pattern segments, at least partially drying the coating of ceramic mold material overlying the array of pattern segments and the ceramic mold material which enters the joints between the pattern segments, leaving projections of ceramic mold material extending from ceramic mold surfaces at locations where the liquid ceramic mold material entered the joints between the pattern segments, disposing of the pattern segments to expose an array of ceramic mold surfaces having configurations corresponding to the configurations of the spaced apart surface areas of the cast product, moving the pattern member away from the ceramic mold surfaces, and removing the projections of ceramic mold material from the mold surfaces.

36. A method of making a mold for a cast product having a plurality of spaced apart surface areas, said method comprising the steps of providing a plurality of disposable pattern segments formed of a relatively flexible material and having surfaces corresponding to the spaced apart surface areas of the cast product, providing a pattern member formed of a material having a greater rigidity than the material forming the pattern segments, clamping each of the pattern segments to the pattern member with the pattern segments disposed in an array with surfaces of the pattern segments abutting at joints which are free of material interconnecting the pattern segments, applying a wet coating of liquid ceramic material over the pattern member and the array of pattern segments with the joints between pattern segments free of material interconnecting the pattern segments and while the pattern segments are clamped to the pattern member, removing at least a major portion of the wet coating of ceramic material overlying a surface area of the pattern member at a location disposed outwardly of the array of pattern segments to separate at least a portion of the coating of wet ceramic material overlying the pattern member from the coating of wet ceramic material overlying the array of pattern segments, at least partially drying the coating of ceramic material overlying the array of pattern segments, disposing of the pattern segments to expose an array of ceramic mold surfaces having configurations corresponding to the configurations of the spaced apart surface areas of the cast product, and moving the pattern member away from the ceramic mold surfaces.

37. A method of making a mold for a cast product having a plurality of airfoils disposed in a circular array, said method comprising the steps of providing a plurality of airfoil pattern segments formed of a relatively flexible and disposable material, providing a circular support member formed of a material having a greater rigidity than material forming the airfoil pattern segments, placing the airfoil pattern segments in a circular array engaging the circular support member to form a pattern assembly, said step of placing the airfoil pattern segments in a circular array includes placing the airfoil pattern segments in an array with joints between the airfoil pattern segments free of material interconnecting the airfoil pattern segments, clamping the airfoil pattern segments with the circular support member to thereby retard movement of the airfoil pattern segments relative to each other and the circular support member while maintaining the joints between the airfoil pattern segments free of material interconnecting the airfoil pattern segments, repetitively dipping the pattern assembly in liquid ceramic mold material to form a covering of ceramic mold material overlying at least a portion of the pattern assembly, at least partially supporting the airfoil pattern segments with the relatively rigid circular support member during said dipping steps, at least partially drying the covering of ceramic mold material overlying the pattern assembly, and disposing of the airfoil pattern segments to expose a circular array of ceramic airfoil mold surfaces having configurations corresponding to the configurations of the airfoil pattern segments.

38. A method as set forth in claim 31 wherein said step of placing the airfoil pattern segments in a circular array includes the step of placing a lower surface area of one end portion of each of the airfoil pattern segments in abutting engagement with the circular support member, said step of clamping the airfoil pattern segments includes the step of clamping the one end portion of each of the airfoil pattern segments against the circular support member.

39. A method of making a mold for a cast product having a plurality of airfoils disposed in a circular array, said method comprising the steps of providing a plurality of airfoil pattern segments formed of a relatively flexible and disposable material, providing a circular pattern member formed of a material having a greater rigidity than material forming the airfoil pattern segments, placing the airfoil pattern segments in a circular array engaging the circular pattern member to form a pattern assembly, said step of placing the airfoil pattern segments in a circular array includes placing the airfoil pattern segments in an array with joints between the airfoil pattern segments free of material interconnecting the airfoil pattern segments so that the airfoil pattern segments can be readily moved relative to each other, connecting the airfoil pattern segments with the circular pattern member to thereby retard movement of the airfoil pattern segments relative to each other and the circular pattern member while maintaining the joints between the airfoil pattern segments free of material interconnecting the airfoil pattern segments, repetitively dipping the pattern assembly in liquid ceramic mold material to form a covering of ceramic mold material overlying at least a portion of the pattern assembly, said step of dipping the pattern assembly in liquid ceramic mold material including the step of flowing liquid ceramic mold material into at least some of the joints between the airfoil pattern segments, at least partially supporting the airfoil pattern segments with the relatively rigid circular pattern member during said dipping steps, at least partially drying the covering of ceramic mold material overlying the pattern assembly, disposing of the airfoil pattern segments to expose a circular array of ceramic airfoil mold surfaces having configurations corresponding to the configurations of the airfoil pattern segments, moving the relatively rigid circular pattern member away from the ceramic airfoil mold surfaces after performing said step of disposing of the airfoil pattern segments, and removing projections of ceramic mold material at locations where the liquid ceramic mold material entered the joints between the airfoil pattern segments.

40. A method as set forth in claim 39 wherein said step of connecting the airfoil pattern segments to the circular pattern member includes the steps of providing an annular connector member and engaging the circular pattern member and an end portion of each of the airfoil pattern segments with the annular connector member.

41. A method as set forth in claim 40 further including the step of disposing of the annular connector member simultaneously with performance of said step of disposing of the airfoil pattern segments.

42. A method as set forth in claim 39 wherein said step of connecting the airfoil pattern segments with the circular pattern member includes the step of clamping one end portion of each of the airfoil pattern segments to the circular pattern member.

43. A method of making a mold for a cast product having a plurality of airfoils disposed in a circular array, said method comprising the steps of providing a plurality of airfoil pattern segments formed of a relatively flexible and disposable material, providing a circular pattern member formed of a material having a greater rigidity than material forming the airfoil pattern segments, placing the airfoil pattern segments in a circular array with radially outer end portions of the airfoil pattern segments engaging the circular pattern member to form a pattern assembly, clamping the radially outer end portion of each of the airfoil pattern segments to the circular pattern member, said step of placing the airfoil pattern segments in a circular array includes the step of placing the airfoil pattern segments in an array with joints between the airfoil pattern segments free of material interconnecting the airfoil pattern segments so that the airfoil pattern segments can be readily moved relative to each other prior to performance of said step of clamping radially outer end portions of the airfoil pattern segments to the circular pattern member, repetitively dipping the pattern assembly in liquid ceramic mold material to form a covering of ceramic mold material overlying at least a portion of the pattern assembly, said step of dipping the pattern assembly includes the step of flowing liquid ceramic mold material into at least some of the joints between the airfoil pattern segments, retarding relative movement between the airfoil pattern segments during said dipping steps by at least partially supporting the airfoil pattern segments with the relatively rigid circular pattern member, at least partially drying the covering of ceramic mold material overlying the pattern assembly, disposing of the airfoil pattern segments to expose a circular array of ceramic airfoil mold surfaces having configurations corresponding to the configurations of the airfoil pattern segments, moving the relatively rigid circular pattern member away from the ceramic airfoil mold surfaces, and removing projections of ceramic mold material at locations where the liquid ceramic mold material entered the joints between the airfoil pattern segments.

44. A method as set forth in claim 43 further including the steps of providing a circular member and engaging the radially inner end portions of each of the airfoil pattern segments with the retaining member.

45. A method as set forth in claim 44 wherein said step of clamping the radially outer end portion of each of the airfoil pattern segments to the circular pattern member includes the step of providing at least one clamp member, said method further including the step of disposing of said clamp member and said retaining member simultaneously with performance of said step of disposing of the airfoil pattern segments.

46. A method of making a mold for a casting product having a plurality of airfoils disposed in a circular array, said method comprising the steps of providing a plurality of wax airfoil pattern segments, providing a circular metal pattern member, clamping each of the wax airfoil pattern segments to the circular metal pattern member to form a circular array of airfoil pattern segments which are connected with the circular metal pattern member, leaving joints between the wax airfoil pattern segments free of material interconnecting the airfoil pattern segments, applying a covering of liquid ceramic mold material over exposed surface areas of the wax airfoil pattern segments and over at least a portion of the circular metal pattern member while the wax airfoil pattern segments are clamped to the circular metal pattern member, at least partially supporting the wax airfoil pattern segments with the circular metal pattern member during the application of the covering of liquid ceramic mold material to the airfoil pattern segments and to the pattern member, forming a circular discontinuity in the covering of ceramic mold material in an area overlying the circular pattern member while the covering of ceramic mold material is wet to at least partially divide the covering of ceramic mold material into portions which can be separated after performing said step of drying the covering of ceramic mold material, at least partially drying the covering of ceramic mold material overlying the wax airfoil pattern segments and circular metal pattern member, and disposing of the wax airfoil pattern segments while maintaining the circular metal pattern member intact and removing the circular pattern member to expose a circular array of ceramic airfoil mold surfaces having configurations corresponding to the configurations of the wax airfoil pattern segments.

47. A method as set forth in claim 46 wherein said step of clamping each of the wax airfoil pattern segments to the circular metal pattern member includes the steps of providing at least one clamp member and pressing a surface of the wax airfoil pattern segment against the metal pattern member with the clamp member.

48. A method as set forth in claim 47 wherein said step of providing a clamp member includes the step of providing a wax clamp member, said method further including the step of disposing of the wax clamp member simultaneously with disposing of the wax airfoil pattern segments.

* * * * *